US006647954B2

(12) United States Patent
Yang et al.

(10) Patent No.: US 6,647,954 B2
(45) Date of Patent: Nov. 18, 2003

(54) METHOD AND SYSTEM OF IMPROVING ENGINE BRAKING BY VARIABLE VALVE ACTUATION

(75) Inventors: Zhou Yang, South Windsor, CT (US); James F. Egan, III, Suffield, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/986,617

(22) Filed: Nov. 9, 2001

(65) Prior Publication Data

US 2002/0056435 A1 May 16, 2002

Related U.S. Application Data

(60) Provisional application No. 60/262,660, filed on Jan. 22, 2001, and provisional application No. 60/066,097, filed on Nov. 17, 1997.

(51) Int. Cl.[7] ..... F02D 13/04

(52) U.S. Cl. ..... 123/321; 123/322; 123/90.12; 123/90.15

(58) Field of Search ..... 123/320, 321, 123/322, 90.12, 90.15

(56) References Cited

U.S. PATENT DOCUMENTS

| | | | | |
|---|---|---|---|---|
| 3,220,392 A | | 11/1965 | Cummins | |
| 3,809,033 A | | 5/1974 | Cartledge | |
| 4,473,047 A | | 9/1984 | Jakuba et al. | |
| 4,523,550 A | * | 6/1985 | Honda et al. | 123/90.16 |
| 4,537,164 A | * | 8/1985 | Ajiki et al. | 123/90.16 |
| 4,545,342 A | * | 10/1985 | Nakano et al. | 123/198 F |
| 4,587,936 A | | 5/1986 | Matsuura et al. | |
| 4,627,391 A | * | 12/1986 | Derringer | 123/90.16 |
| 5,000,145 A | | 3/1991 | Quenneville | |
| 5,003,939 A | | 4/1991 | King | |
| 5,373,817 A | | 12/1994 | Schechter et al. | |
| 5,577,468 A | | 11/1996 | Weber | |
| 5,636,609 A | * | 6/1997 | Fujiyoshi | 123/198 F |
| 5,680,841 A | | 10/1997 | Hu | |
| 5,787,859 A | | 8/1998 | Meistrick et al. | |
| 5,809,964 A | | 9/1998 | Meistrick et al. | |
| 5,829,397 A | | 11/1998 | Vorih et al. | |
| 5,921,216 A | * | 7/1999 | Ballman et al. | 123/321 |
| 6,082,328 A | | 7/2000 | Meistrick et al. | |
| 6,085,705 A | | 7/2000 | Vorih | |
| 6,125,828 A | * | 10/2000 | Hu | 123/321 |
| 6,220,032 B1 | * | 4/2001 | Schmidt et al. | 123/322 |
| 6,234,143 B1 | * | 5/2001 | Bartel et al. | 123/321 |
| 6,237,551 B1 | * | 5/2001 | Macor et al. | 123/90.15 |
| 6,321,701 B1 | * | 11/2001 | Vorih et al. | 123/90.12 |
| 6,354,266 B1 | * | 3/2002 | Cornell et al. | 123/142.5 R |
| 6,386,160 B1 | * | 5/2002 | Meneely et al. | 123/90.16 |
| 6,394,067 B1 | * | 5/2002 | Usko et al. | 123/321 |

* cited by examiner

*Primary Examiner*—Erick Solis
(74) *Attorney, Agent, or Firm*—Collier, Shannon, Scott, PLLC; Mark W. Rygiel

(57) ABSTRACT

The present invention relates to methods of improving engine braking of a reciprocating piston internal combustion engine by variable valve actuation. One embodiment of the present invention enables independent two-valve actuation for each cylinder, and engine braking horsepower can be optimized using two-valve braking at high engine speeds and one-valve braking at low speeds. Another embodiment of the present invention enables better a sequential valve actuation to reduce engine braking load and compliance. Another embodiment of the present invention enables better engine starting and warming up by controlling timing and lift of each valve.

29 Claims, 7 Drawing Sheets

METHOD AND SYSTEM OF IMPROVING ENGINE BRAKING BY VARIABLE VALVE ACTUATION

CROSS REFERENCE TO RELATED PATENT APPLICATION

This application claims priority on U.S. Provisional Patent Application Serial No. 60/262,660, for Methods of Improving Engine Braking By Variable Valve Actuation, filed Jan. 22, 2001, a copy of which is incorporated herein by reference. This application is related to U.S. Provisional Patent Application Serial No. 60/066,097 filed Nov. 17, 1997, for Sequential Intake and Exhaust Valve Opening System For Multi-Valve Internal Combustion Engines, a copy of which is also incorporated herein by reference.

FIELD OF THE INVENTION

The present invention relates to a method and system for improving engine braking. In particular, the present invention relates to methods and systems using variable valve operation to improve engine braking performance.

BACKGROUND OF THE INVENTION

Valve actuation in an internal combustion engine is required in order for the engine to produce positive power. During positive power operation of an engine, one or more intake valves may be opened to allow air and fuel into a cylinder for combustion. This intake event is routinely carried out while the piston in the cylinder travels from a near top dead center (TDC) position to a near bottom dead center (BDC) position. After the intake stroke, the intake valve(s) are closed and the air/fuel charge in the cylinder is compressed as the piston travels back from the BDC position to a TDC position during a compression stroke. The compressed mixture is combusted around TDC, which drives the piston back toward a BDC position during what is known as an expansion stroke. Following the expansion stroke, one or more exhaust valves that communicate with the cylinder may be opened to allow the combustion gas to escape therefrom. The foregoing intake and exhaust valve events are commonly referred to as the main intake and main exhaust events, respectively.

During engine braking, the exhaust valves may be selectively opened to convert, at least temporarily, a power producing internal combustion engine into a power absorbing air compressor. As a piston travels upward during its compression stroke, the gases that are trapped in the cylinder are compressed. The compressed gases oppose the upward motion of the piston. During engine braking operation, as the piston nears TDC, at least one exhaust valve is opened to release the compressed gases to atmosphere, preventing the energy stored in the compressed gases from being returned to the engine on the subsequent expansion downstroke. In doing so, the engine develops retarding power to help slow the vehicle down.

The operation of a compression-release type engine brake, as described in the preceding paragraph, has long been known. One of the earliest descriptions of a system used for compression-release braking is provided in Cummins, U.S. Pat. No. 3,220,392. The system described in the Cummins '392 patent derives the motion to open a pair of exhaust valves for a compression-release event from an existing intake, exhaust, or injector pushrod or rocker arm. The compression-release motion is conveyed from a pushrod or rocker arm to a bridge joining two exhaust valves by a selectively expandable hydraulic linkage. This hydraulic linkage is expanded to convey the compression-release motion during engine braking operation, and contracted to absorb such motion during positive power operation. The contraction of the hydraulic linkage during positive power operation causes the compression-release motion to be "lost" during positive power, and accordingly, such systems are commonly referred to as "lost motion" valve actuation systems.

As shown in the Cummins '392 patent, many contemporary engines are multi-valve engines that employ, for example, four valves per cylinder, i.e., two intake valves and two exhaust valves, in order to improve overall performance. The conventional multi-valve actuation system typically opens both intake or both exhaust valves for a particular cylinder simultaneously. For example, in various embodiments described in the Cummins '392 patent, both of the exhaust valves for a given cylinder are actuated (opened and closed) simultaneously for a compression-release event. Because the two exhaust valves are actuated in response to motion imparted by a single source, both exhaust valves are provided with substantially the same lift and duration, in addition to being provided with substantially identical timing.

Over the years there have been various improvements to the systems and methods described in the Cummins '392 patent. One such improvement is described in Jakuba et al., U.S. Pat. No. 4,473,047. Like the system described in the Cummins patent, the Jakuba patent describes the use of a lost motion system in conjunction with an engine having two exhaust valves per cylinder. However, unlike the system described in the Cummins patent, the system described in the Jakuba patent conveys the compression-release motion to only one of the two exhaust valves associated with each engine cylinder. The inventors of the Jakuba system stated that they, "discovered that by opening only one of the exhaust valves during engine braking a surprising increase in retarding horsepower can be achieved. The increase in retarding horsepower is accompanied by a decrease in the observed operating pressure in the hydraulic system and is related to a decrease in the overall load in parts of the braking system."

For a system designed for two-valve braking with one rocker arm, the braking load is basically cut into half by opening only one valve if the same peak cylinder pressure is maintained before compression-release blow-down. Therefore, the system should be able to sustain much higher cylinder pressure by a later opening of one valve to achieve higher retarding power and lower overall braking load at the same time. As described in more detail below, the Applicant has determined that if two individual rocker arms are used to open the two valves independently, then opening two valves is better than opening one due to faster compression-release blow-down from the same high peak cylinder pressure since braking load is not an issue for two valve braking with two rocker arms.

Other improvements over the system described in the Cummins patent have involved hardware, which falls into two broad categories: lost motion systems, and common rail systems. Several advancements in lost motion systems have been made to accommodate the modern prevalence of overhead cam engines. For example, recent lost motion system advancements have involved the placement of the hydraulic linkage in expandable tappets between a cam and a rocker arm or the engine valve itself, such as shown in Vorih et al., U.S. Pat. No. 5,829,397, which is hereby incorporated by reference. Lost motion components have also been integrated into rocker arms, such as is shown in Cartledge, U.S. Pat. No. 3,809,033, and Hu, U.S. Pat. No. 5,680,841, which are hereby incorporated by reference. Still other lost motion advancements, such as those shown in Vorih, U.S. Pat. No. 6,085,705 and which is hereby incorporated by reference, have been made to enable variable valve actuation (WA), which provides for the modification of individual valve actuation events on an engine cycle-by-cycle basis.

In the lost motion systems described above, the engine valves are typically driven by fixed profile cams, more specifically, by one or more fixed lobes on each of the cams. The use of fixed profile cams makes it difficult to adjust the timing and/or magnitude of the engine valve lift needed to optimize engine performance for various engine operating conditions, such as different engine speeds during engine braking. Rapid adjustment of valve timing in a system utilizing fixed profile cams is only now becoming viable using WA systems such as the one described in the Vorih '705 patent.

In common rail valve actuation systems, a source of high pressure hydraulic fluid is selectively applied to a piston to actuate the one or more exhaust valves for the compression-release events. Examples of such systems are shown in Meistrick et al., U.S. Pat. Nos. 5,787,859, 5,809,964, and 6,082,328, which are hereby incorporated by reference.

Common rail systems may provide virtually limitless adjustment to valve timing because the source of high pressure hydraulic fluid is constantly available for valve actuation. Accordingly, given sophisticated and high speed control over the application of this hydraulic pressure, a common rail system should be able to deliver valve actuation on demand, as well as provide some control over lift and duration. To date, however, such sophisticated control, particularly in the seating of engine valves has not been effectively realized. Two problems in particular that tend to discourage the use of common rail actuation systems are the expense of the components required to exercise the level of control called for, and the susceptibility of the system to complete failure in the event of a loss in hydraulic pressure. Until these problems are solved, it is likely that lost motion systems will continue to be the predominate type of system used to carry out engine braking.

The ideal compression-release braking cycle should have both the maximum (peak) and minimum cylinder pressures occur at the compression TDC, which means that the braking valve(s) would not be opened until TDC and then the compression-release blow-down event would happen instantaneously. Therefore, a combination of late valve opening toward TDC and then a fast compression-release blow-down after the TDC maximizes engine braking power Compression-release (or valve actuation) timing is controlled by braking load. The closer the piston is to TDC, the greater the pressure in the cylinder, and accordingly, the greater the load placed on the elements that must carry out the valve opening event. Increased braking loads result in increased loads on both the structural components and the hydraulic fluid used to carry out a compression-release event. With increasing load, the structural components may be deformed and hydraulic compliance may be increased, which may affect the timing and degree of exhaust valve actuation for a compression-release event. Small losses due to structural deformation and hydraulic compliance could potentially result in loss of the entire compression-release event because of the relatively small magnitude of the event to begin with. Thus, component strength and hydraulic compliance limit the piston position at which a system is capable of initiating a compression-release event relative to TDC.

The compression-release (or blow down) speed is controlled by valve opening area that could be increased by increasing the number of exhaust valves for the braking event. Therefore, opening two exhaust valves would achieve higher braking power than opening only one valve for compression-release of braking gases from the same peak cylinder pressure.

It is also known that fixed timing compression-release valve actuation systems provide optimal engine braking power for only one engine speed. Compression-release actuation for high engine speeds may be constrained by valve-train loading limits that necessitate advancing the time before TDC at which the exhaust valve(s) are opened. The advancement of the compression-release event for high engine speeds, however, provides reduced braking power at low engine speeds.

While a WA system or a common rail system could provide optimal engine braking power for a range of engine speeds, such systems tend to be complex and costly. Accordingly, there is a need for a method of valve actuation that provides improved engine braking power at a plurality of engine speeds without necessitating the use of a complicated WA system. There is also a need for a method of valve actuation that provides improved engine braking power without subjecting the system used for such braking to undesirably high loads.

To date, the Applicants are unaware of any system that actively determines the number of exhaust valves that should be actuated to optimize braking power. The Applicants have further determined that such a system could be used to optimize braking power over a range of engine speeds, as well as reduce the load placed on the engine braking elements at some engine speeds. Thus, there is a need for a system and method that is capable of determining whether two or one exhaust valves should be opened for an optimal engine braking event. Furthermore, there is a need for a system and method that can change between actuating one or two exhaust valves for engine braking based on the determination of which will provide optimal braking power and/or optimal engine braking element loading.

As explained above, normally the advancement of the opening time of the exhaust valves for a compression-release event will decrease braking power because there is less pressure in the cylinder to release. To some extent, however, this loss of power must be tolerated because of the increased load experienced by the system as the opening event is moved closer to TDC. Thus, there is a need for a method of engine braking that takes advantage of the lower loading resulting from initiating the compression-release event at an earlier time in the cycle, but avoids the drastic loss of braking power that usually accompanies the earlier initiation of the compression-release event.

It is known that staggering the opening times of intake and exhaust valves may be used to improve fuel economy, reduce exhaust emissions, and increase positive power. Such a system is described in King, U.S. Pat. No. 5,003,939. While such a system has been used to improve positive power performance, Applicants are unaware of any discussion of the staggering of the opening times of exhaust valves to optimize compression-release engine braking. In this regard, the Applicants have determined that the loading of the elements used to open two exhaust valves for a compression-release event may be reduced without a substantial loss in braking power by staggering the times at which each of the two exhaust valves are opened relative to TDC. Thus, there is a need for a system and method that is capable of staggering the opening of or sequentially opening two exhaust valves for a compression-release event.

OBJECTS OF THE INVENTION

Therefore, it is an object of the present invention to provide improved engine braking using variable valve operation.

It is another object of the present invention to provide a system and method for improving engine braking by switching between multiple valve actuation and single valve actuation.

It is another object of the present invention to provide a system and method for improving engine braking by using sequential valve actuation.

It is another object of the present invention to provide a system and method for improving engine braking by varying valve lift.

It is still another object of the present invention to provide a system and method for reducing valve train loading during engine braking.

It is yet another object of the present invention to provide a system and method for reducing valve train compliance during engine braking.

It is another object of the present invention to provide a system and method for optimum operation of the engine brake over a range of engine speeds by controlling the number of exhaust valves that open, and the timing and the lift of each valve.

It is still another object of the present invention to provide a system and method for reducing the number, weight and size of various engine components required for engine braking.

It is still another object of the present invention to provide improved engine performance during firing (positive power) cycles by controlling the numbers of valves which open, the timing and the lift of each valve.

It is still another object of the present invention to improve engine start and warm up by controlling the numbers of valves which open, the timing and lift of each valve and more specifically by operating some cylinders in a positive power mode and some cylinders in a braking mode simultaneously.

Additional objects and advantages of the invention are set forth, in part, in the description that follows and, in part, will be apparent to one of ordinary skill in the art from the description and/or from the practice of the invention.

SUMMARY OF THE INVENTION

The present invention is directed to a method and system for using variable valve operation to improve engine braking performance. In a preferred embodiment, the present invention is a method of optimizing engine braking power for multiple engine speeds in a multi-valve internal combustion engine. The method comprises the steps of selecting an engine speed as a cross-over point between one-valve engine braking and multi-valve engine braking; measuring an engine parameter to determine the current engine speed; determining whether the current engine speed is above, equal to, or below the cross-over point engine speed; and modifying the operation of at least one engine valve responsive to the determination of whether the current engine speed is above, equal to, or below the cross-over point engine speed.

The step of modifying the operation of at least one engine valve may comprise the step of modifying the number of engine valves actuated, the step of modifying the timing of the operation of at least one engine valve, and/or the step of modifying the lift of at least one engine valve. The engine valve may include an intake and/or an exhaust valve.

In another preferred embodiment, the present invention is a valve actuation system for actuating at least one engine valve to produce an engine valve event in a multi-valve internal combustion engine. The valve actuation system may comprise a housing, having a fluid linkage formed therein; means for selectively displacing hydraulic fluid located in the fluid linkage; means for controlling the displacement of the hydraulic fluid in the fluid linkage to modify the operation of the at least one engine valve responsive to a determination of the current engine speed; and means for actuating the at least one engine valve to produce the engine valve event, wherein the actuation means is slidably received in the housing and operatively connected to the displacement means through the fluid linkage.

The displacement control means may modify the number of engine valves actuated, the timing of the engine valves actuated, and/or the lift of the engine valves actuated. The engine valve event may be an intake valve event, a compression release engine braking event, a bleeder braking event, and/or an EGR event.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and together with the detailed description serve to explain the principles of the present invention.

BRIEF DESCRIPTION OF THE DRAWINGS

The present invention will now be described in connection with the following figures in which like reference numbers refer to like elements and wherein.

DETAILED DESCRIPTION OF THE PREFERRED EMBODIMENTS

Reference will now be made in detail to a preferred embodiment of the system and method of the present invention, examples of which are illustrated in the accompanying drawings. A preferred system of the present invention will be described, followed by a preferred method of the present invention and alternative embodiments of the present invention.

SYSTEM OF THE PRESENT INVENTION

Figure 1:
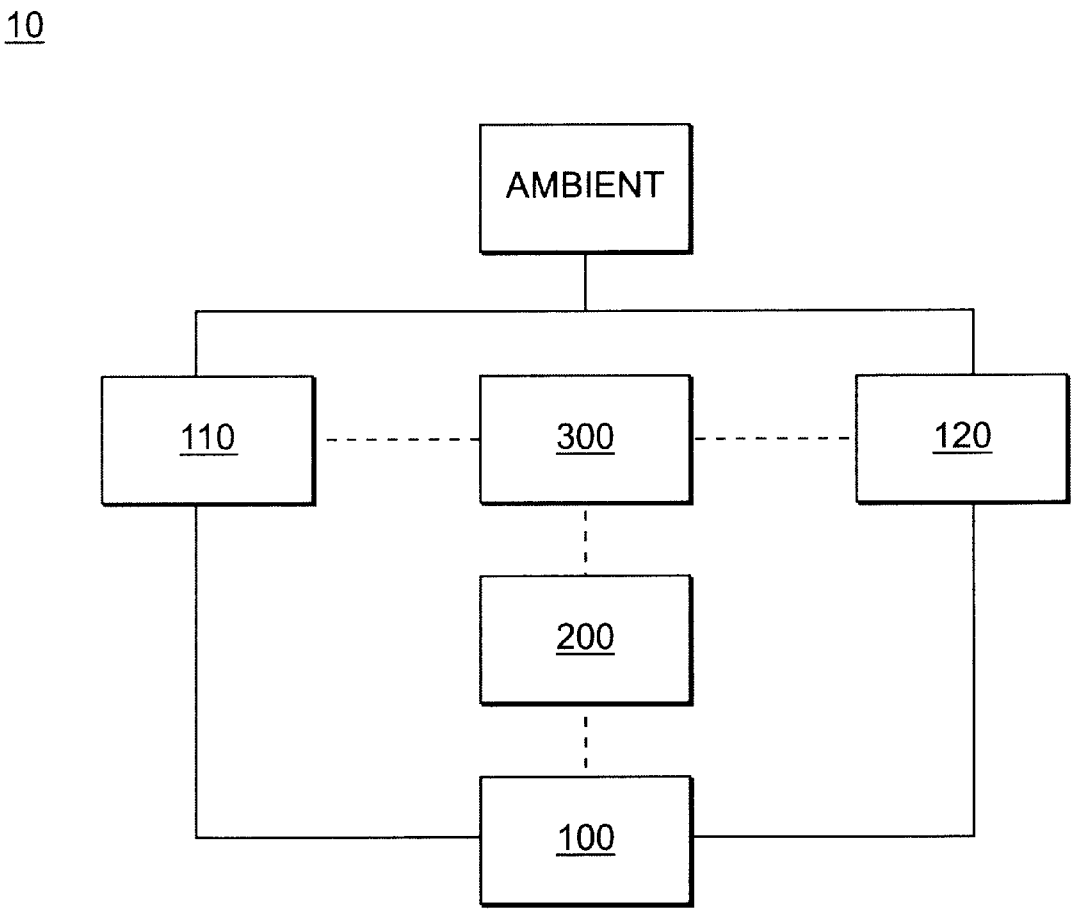
FIG. 1 is a schematic diagram of a engine system according to a preferred embodiment of the present invention.

A preferred embodiment of the engine system 10 of the present invention is illustrated in FIG. 1. The engine system 10 includes an engine block 100 connected to an intake manifold 110 and an exhaust manifold 120. The engine block 100 includes a plurality of engine valves, and at least one engine cylinder (not shown). The plurality of engine valves may include one or more intake valves and one or more exhaust valves. The engine system further includes a valve actuation subsystem 200, and engine control means 300.

The valve actuation subsystem 200 is adapted to selectively actuate one or more engine valves (preferably, exhaust valves) for engine braking according to the methods of the present invention. In the preferred embodiment of the present invention, the valve actuation subsystem 200 opens at least one engine valve to produce a compression-release braking event in each engine cylinder. It is contemplated, however, that the valve actuation subsystem 200 may be used to produce main, brake, exhaust gas recirculation, and/or other auxiliary engine valve events. The valve actuation subsystem 200 may comprise various hydraulic, hydromechanical, and/or other actuation means, known or newly discovered, adapted to carry out the actuation of at least one engine valve according to the methods of the present invention. Embodiments of the valve actuation subsystem 200 will be discussed in detail below.

The engine control means (ECM) 300 controls the valve actuation subsystem 200 such that the desired level and type of engine braking is achieved. The ECM 300 preferably includes a computer and is preferably connected to sensors through any connection means, such as electrical wiring or gas passageways, to the engine cylinder, the intake manifold 110, the exhaust manifold 120, or any other part of the engine system 10. Preferably, the ECM 300 is also connected to an appropriate engine component, such as, for example, a tachometer, capable of providing the ECM 300 with a measurement of engine speed. It is contemplated that the ECM 300 may be used to measure other engine parameters, such as, for example, the intake manifold pressure, the exhaust manifold pressure, and the exhaust manifold temperature. Moreover, the ECM 300 includes means for comparing the current engine speed to a reference speed, such as, for example, a cross-over engine speed 400, discussed below.

METHOD OF THE PRESENT INVENTION

Figure 2:
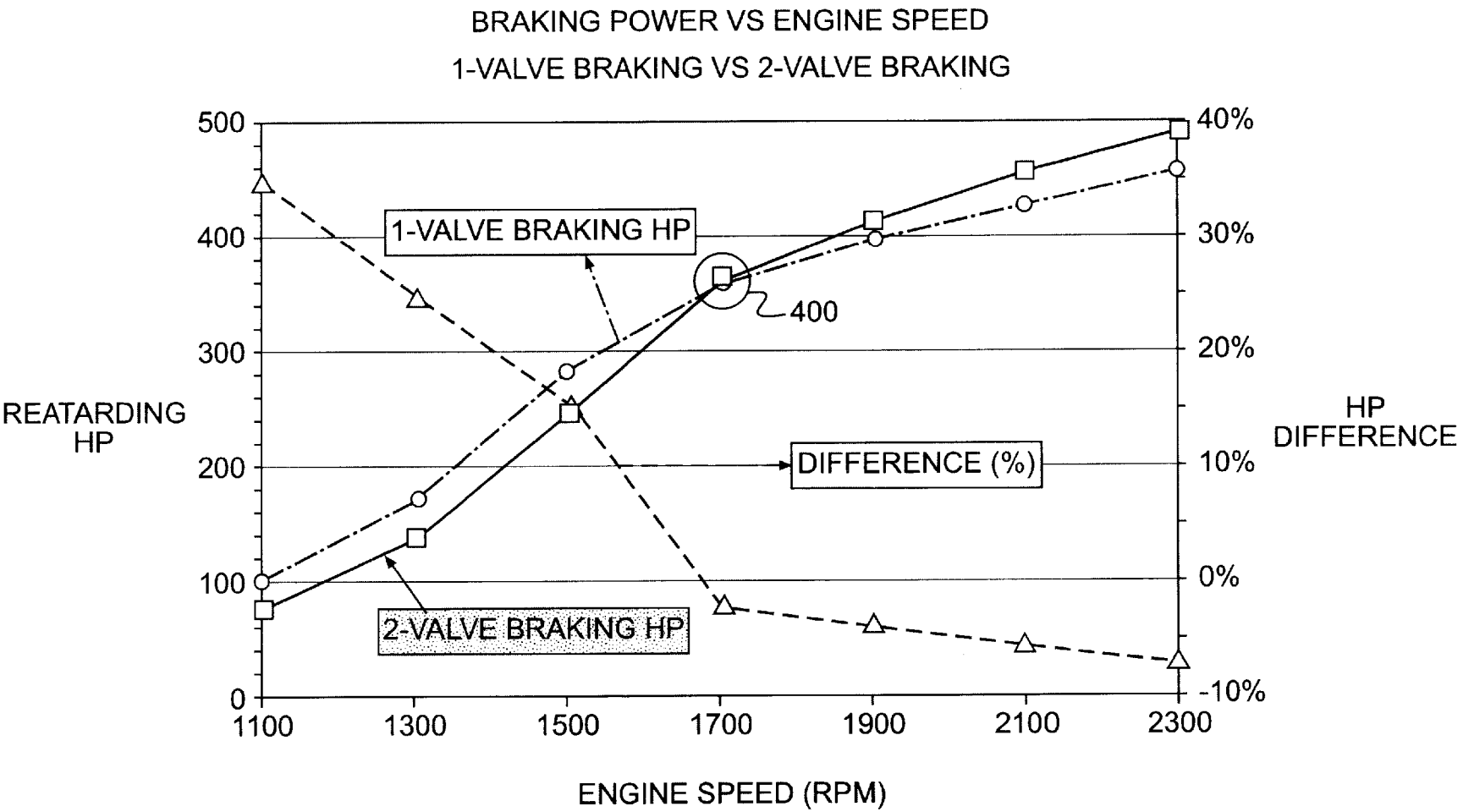
FIG. 2 is a graphical representation of braking power versus engine speed according to an embodiment of the present invention.
Figure 3:
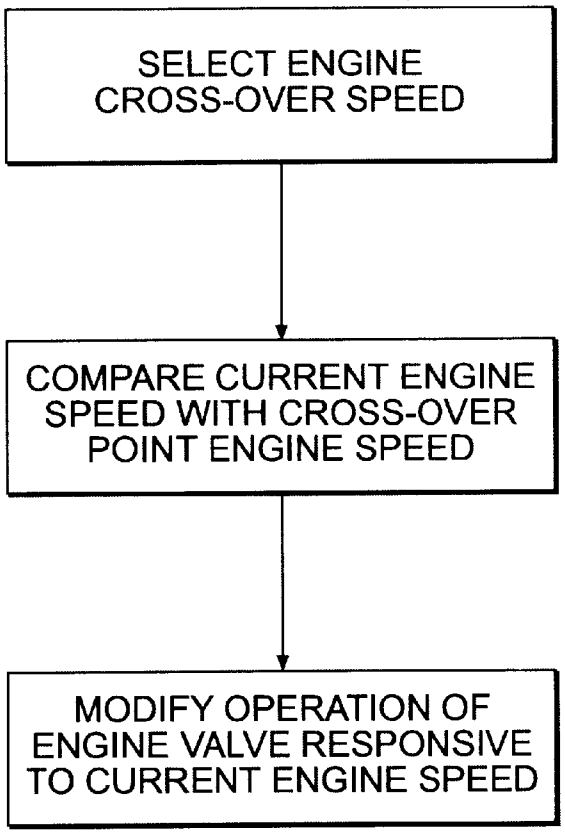
FIG. 3 is a process diagram illustrating the process of providing variable valve actuation according to a first embodiment of the present invention.

In a preferred embodiment, the present invention is a method of optimizing engine braking power for multiple engine speeds in an engine having a plurality of engine valves. FIG. 2 is a graphical representation of braking power versus engine speed according to an embodiment of the present invention. Based on data such as that provided in FIG. 2, a cross-over engine speed 400 may be determined at which modifying the operation of at least one engine valve optimizes the engine braking power. It is to be understood that FIG. 2 is for exemplary purposes only, and, as will be apparent to those of ordinary skill in the art, the actual values represented, including the crossover engine speed 400, may vary depending on a variety of factors, such as, for example, the specifications of the engine 100. FIG. 3 is a process diagram illustrating the process of providing variable valve actuation according to a preferred embodiment of the present invention.

In one preferred embodiment, a cross-over engine speed 400 may be determined at which two-valve engine braking events provide greater braking horsepower than one-valve engine braking events. When engine braking is called for at an engine speed equal to or less than the cross-over engine speed 400, one-valve braking may be carried out. When engine braking is called for at an engine speed greater than the cross-over engine speed 400, two-valve braking may be carried out. Thus, braking horsepower may be optimized by using two-valve braking at high engine speeds and one-valve braking at low speeds.

In the system represented by the data in FIG. 2, a fixed timing on-off braking system is designed to have optimized performance at a high (rated) engine speed with two-valve actuation by two rocker arms. The exhaust valve lift timing for each of the two valves is designed to be as close to the TDC of the compression stroke as possible to achieve the highest compression pressure and braking power without exceeding valve train loading limit. This initial setting provides optimized engine braking for speeds above the cross-over engine speed 400.

In accordance with the subject method, as engine speed decreases, the compression pressure (and braking load) decreases. When the engine speed falls below the cross-over speed 400, the blow-down of the compressed gases by opening two valves occurs so fast that the peak cylinder pressure is reduced and shifted away (advanced) from TDC, which causes the braking power of the system to be reduced. By switching from two-valve braking to one-valve braking at lower engine speeds, blow-down is slowed. The slowing of blow-down is essentially equivalent to moving the compression-release event closer to TDC, which in turn increases engine braking power.

FIG. 2 shows that the two stage braking strategy of the present invention (two-valve braking at speeds above the cross-over point and one-valve braking at speeds below) increases braking power substantially (as high as 35 percent) at lower speeds. Note that the loss of braking power at high engine speeds by one-valve actuation is quite small (about 7 percent or less).

Figure 4:
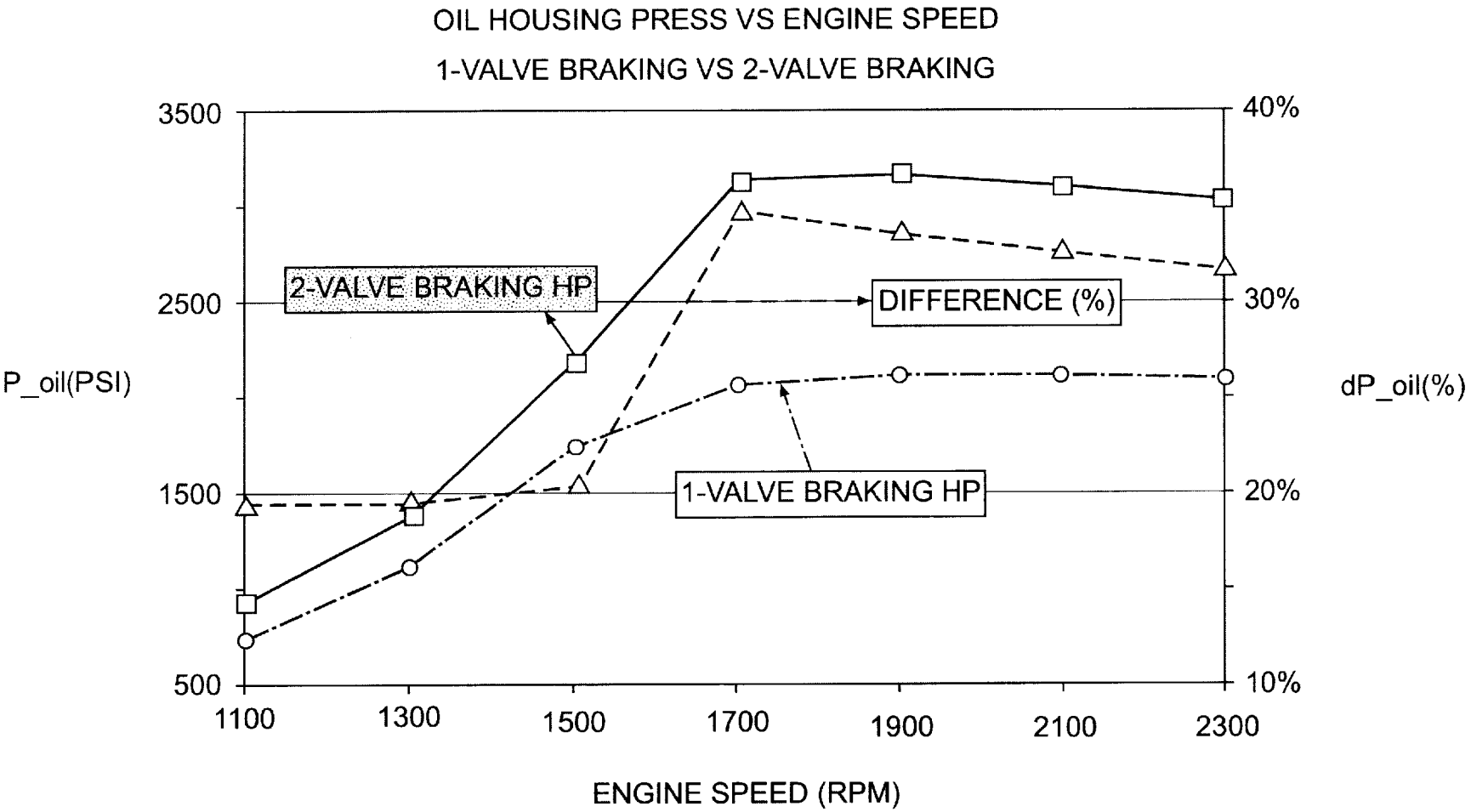
FIG. 4 is a graphical representation of oil housing pressure versus engine speed according to an embodiment of the present invention.

Similarly, FIG. 4, which is a graphical representation of oil housing pressure versus engine speed according to one embodiment of the present invention, shows that braking load (housing oil pressure) is much lower (up to 35%) as a result of actuating one valve rather than two valves through hydraulic means with a single rocker arm. Again, it is to be understood that FIG. 4 is for exemplary purposes only, and, as will be apparent to those of ordinary skill in the art, the actual values represented may vary depending on a variety of factors, such as, for example, the specifications of the engine 100.

In another embodiment of the present invention, the operation of at least one engine valve may be modified by modifying the timing of each engine valve for a given cylinder. As explained in connection with the discussion of the Jakuba patent, during engine braking, opening two exhaust valves against high cylinder pressure by a single rocker may yield high rocker arm load and compliance. The sequential opening of the two exhaust valves requires less force than opening them simultaneously, since the first valve would open against a fully charged cylinder and then the second would open for a faster blow-down of the compressed gases. For example, instead of opening both valves at 17 crank degrees before TDC against 100 bar of cylinder pressure, one valve can be opened at approximately 20 degrees before TDC against approximately 90 bar pressure and the second at approximately 14 degrees before TDC against approximately 80 bar pressure. Other values for the timing modification are considered within the scope of the present invention. The exact timing may depend on the specifications of the engine 100, and/or other variables including turbo charger setting, compression ratio, intake boost and valve seat diameter. It is contemplated that the modification of the timing and/or lift of the at least one engine valve may occur without a determination of the cross-over engine speed 400.

In one embodiment of the present invention, the opening time of at least one engine valve may be advanced during a cylinder compression stroke. The closing time of at least one engine valve may be delayed during a cylinder compression stroke.

In one embodiment of the present invention, the timing of the engine valves may be modified by opening a first engine valve during a cylinder compression stroke and opening a second exhaust valve during the cylinder compression stroke at a predetermined time after the opening of the first engine valve. The predetermined time may be determined based on a variety of factors, such as, for example, braking load limits.

In another embodiment of the present invention, the separation of the opening and closing times of each valve servicing a cylinder, and each valve's lift, may be varied by providing a separate means for actuating each valve. The ability to vary the timing and lift of each valve is an important improvement over conventional systems. For example, the ability to maintain certain engine valves closed during the combustion or braking cycle, allows the system of the present invention to convert a multi-valve engine into a conventional one intake or exhaust valve system. Any number of engine valve combinations may be used, i.e., multiple intake valves may be cycled with a single exhaust valve or vice versa.

When used in conjunction with an engine in the firing (positive power) mode, an embodiment of the present invention offers numerous advantages. For example, the amount of swirl or air-fuel mixing during the intake stroke can be finely tuned by controlling the following parameters: numbers of intake valves which lift; the amount of valve lift; and/or the timing and duration of valve lift. In an engine with at least a pair of intake valves for each cylinder, sequential opening of the valves may enhance the swirl or mixing of air and fuel during intake and improve engine performance.

When used in conjunction with an engine in the braking mode, the embodiment of the present invention that provides for independent actuation of each valve servicing a cylinder offers numerous advantages. The amount of braking can be finely tuned by controlling the following parameters: numbers of exhaust valves that lift; the amount of valve lift; and/or the timing and duration of valve lift. In an engine with at least a pair of exhaust valves for each cylinder, the magnitude of the braking force may be controlled by varying the number of exhaust valves which open. For example, if only one exhaust valve per cylinder lifts during the braking cycle different braking will be provided than if both lift.

ALTERNATIVE EMBODIMENTS OF THE PRESENT INVENTION

As discussed above, the valve actuation subsystem 200 of the present invention is adapted to selectively actuate one or more engine valves for engine braking according to the methods of the present invention. In the preferred embodiment, the valve actuation subsystem 200 is a multi-valve actuation system 2100.

Figure 5:
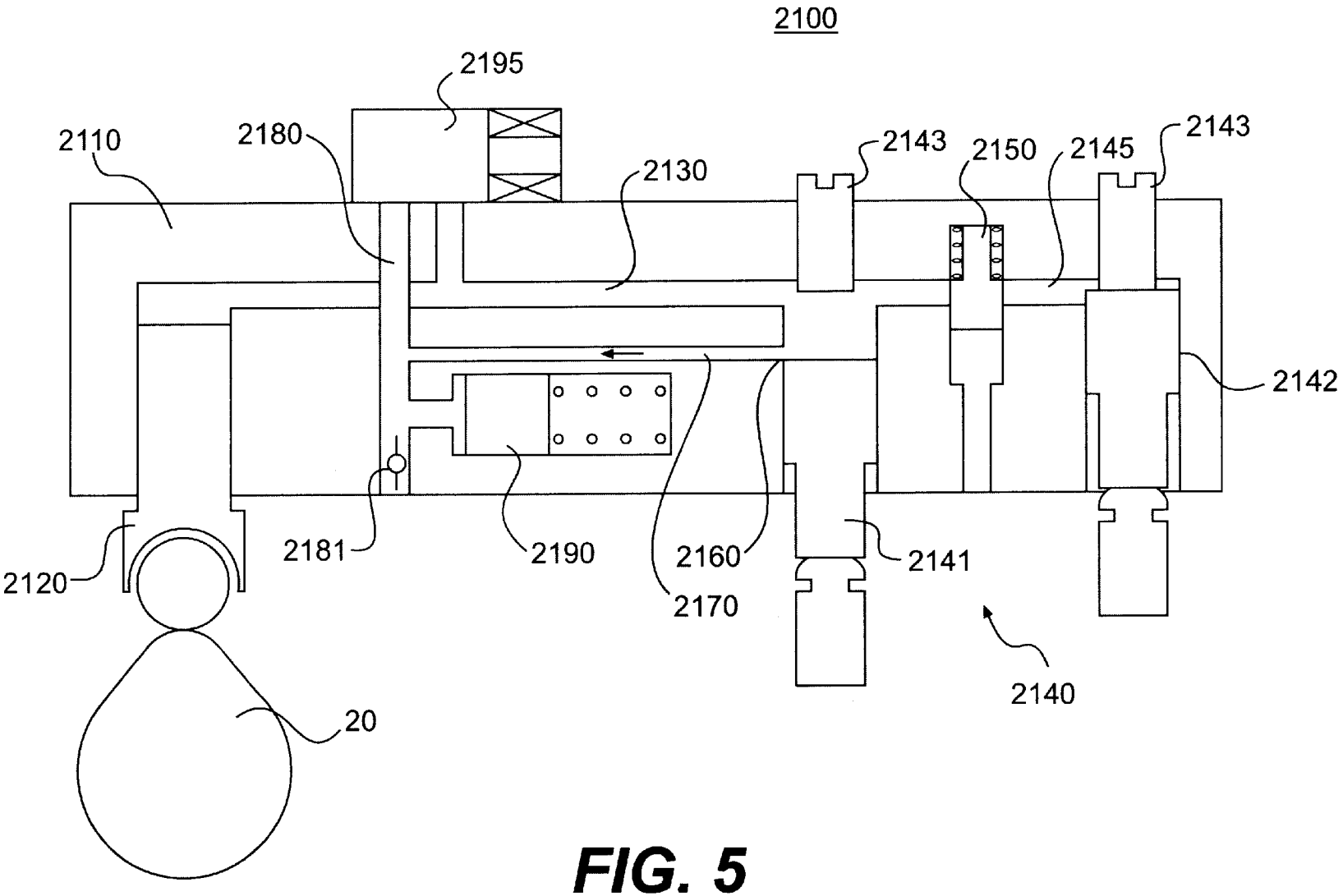
FIG. 5 is a schematic diagram of a valve actuation system according to a first embodiment of the present invention.

As shown in FIG. 5, the system 2100 includes a housing 2110. A master piston assembly 2120 may be slidably received within the housing 2110. The master piston assembly 2120 preferably derives motion from a cam 20. Motion generated by the master piston assembly 2120 is transmitted through hydraulic fluid (such as, for example, engine oil) located within a fluid linkage 2130 located within housing 2110. The housing 2110 further includes at least one slave piston assembly 2140. The system 2100 preferably includes a first slave piston assembly 2141 and a second slave piston assembly 2142. Each slave piston assembly 2141 and 2142 is capable of operating at least one cylinder valve.

Each slave piston assembly 2141 and 2142 is operatively connected by a conduit 2145. A valve 2150 may be located between the slave piston assemblies 2141 and 2142. The valve 2150 may be, for example, a pressure valve or a pilot valve. The valve 2150 operates in response to pilot pressure. The pressure to operate valve 2150 may be provided by engine oil, for example. The valve 2150, when in an actuated position, as shown in FIG. 5, blocks the flow of hydraulic fluid to the second slave piston assembly 2142. The valve 2150 permits the system 2100 to switch between single valve operation and multiple valve actuation.

When the valve 2150 is in an actuated position (i.e., only the first slave piston assembly 2141 operates in response to the master piston assembly 2120), the operation of the slave piston assembly 2141 occurs at a more rapid rate. In this mode, the single slave piston assembly 2141 may operate at nearly twice the rate of the operation of two slave piston assemblies because of the increased hydraulic ratio.

Additionally, the stroke of the slave piston assembly 2141 may also increase. Accordingly, it is necessary to limit the stroke of the slave piston assembly 2141 to prevent excess travel of the slave piston assembly 2141. The system 2100 may be provided with adjustable assemblies 2143 to limit the upward travel of the slave piston assemblies 2141 and 2142. This prevents potential damage to both the slave piston assembly and the cylinder valves operated by the slave piston assembly 2141.

The excess stroke of the slave piston assembly 2141 is absorbed by a stroke limiting assembly. During the downward travel the slave piston assembly 2141, a relief port 2160 is opened to permit the flow of excess hydraulic fluid. The excess hydraulic fluid then flows through fluid linkages 2170 and 2180 to an accumulator assembly 2190. The accumulator assembly 2190 may be a piston-type accumulator, gas-type accumulator or other suitable pressure absorbing device.

One end of the fluid linkage 2180 may be connected to a supply of hydraulic fluid. A valve 2181 may be provided within the fluid linkage 2180 to prevent the back flow of hydraulic fluid to the supply, not shown. The other end of the fluid linkage 2180 may be connected to a trigger valve 2195. The trigger valve 2195 permits the flow of hydraulic fluid into the fluid linkage 2130 to fill the system 2100 with hydraulic fluid, as well as to modify transmitted motion by venting hydraulic fluid into the accumulator 2190. The fluid linkage 2170 may be provided with a check valve, not shown, to prevent the back flow of hydraulic fluid to the slave piston assembly 2141.

The operation of the system 2100 will now be described. During multi-valve operation, the trigger valve 2195 is operated to ensure that the system 2100 has a sufficient supply of hydraulic fluid. The valve 2150 is open, or deactivated, to permit the flow of hydraulic fluid to both the slave piston assemblies 2141 and 2142 in response to motion derived by the master piston assembly 2120 from the cam 20. The slave piston assemblies 2141 and 2142 move equally in response to the master piston assembly 2120. When single valve operation is desired, the valve 2150 is activated to shut off the supply of hydraulic fluid to the slave piston assembly 2142. The slave piston assembly 2142 will not respond to master piston assembly movement. The slave piston assembly 2141 now operates at an increased rate. The excess stroke is absorbed by venting the excess hydraulic fluid through the relief port 2160 and the fluid linkage 2170 to the accumulator 2190. The single slave piston assembly 2141 may now safely operate. When multiple valve actuation is again desired, the valve 2150 is deactivated. The hydraulic fluid can then flow to slave piston assembly 2142 via conduit 2145. The trigger valve 2195 is operated to ensure that the system 2100 is provided with a sufficient supply of hydraulic fluid.

Figure 6:
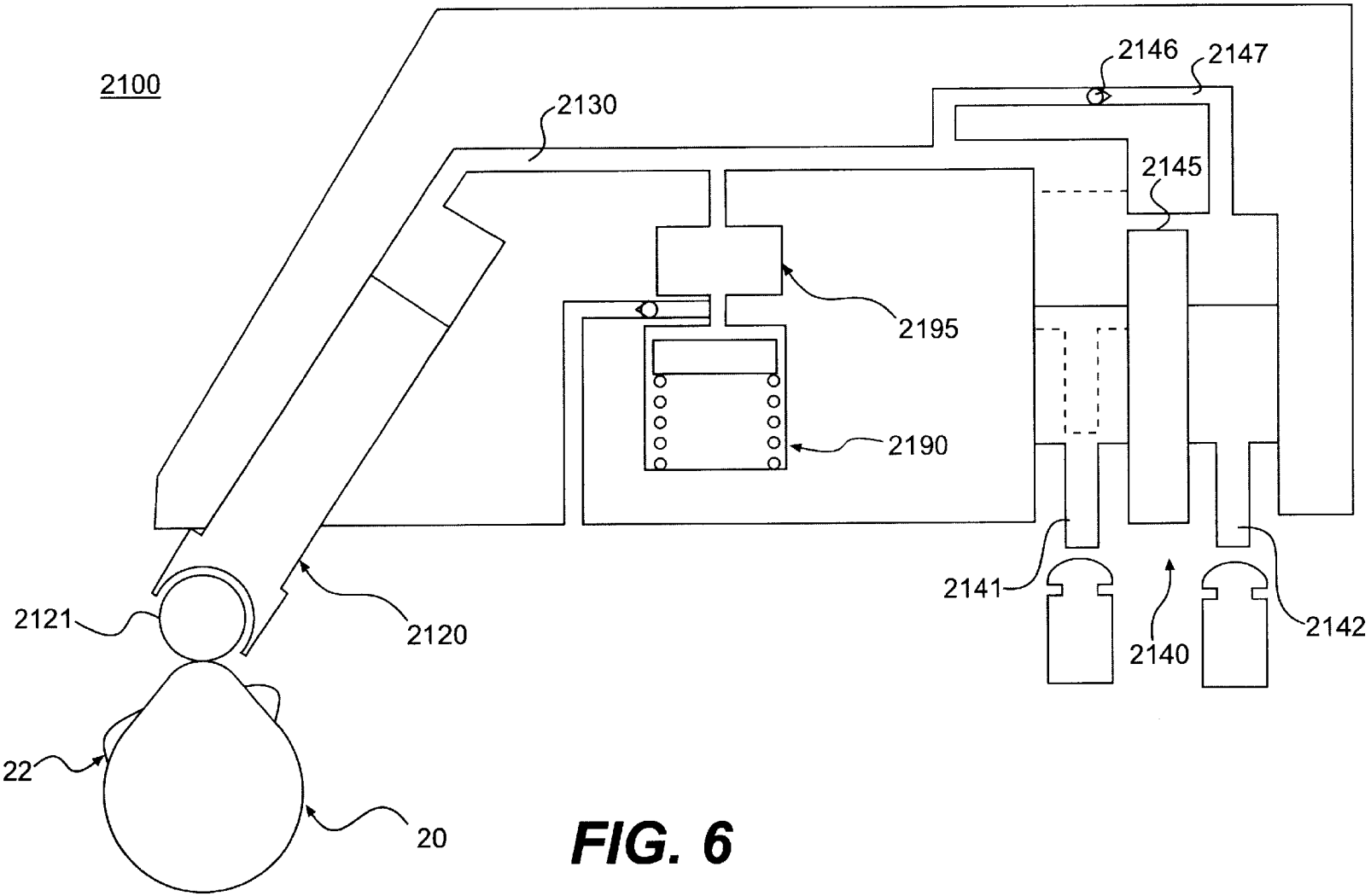
FIG. 6 is a schematic diagram of a valve actuation system according to a second embodiment of the present invention.

FIG. 6 is an example of a second embodiment of the present invention, in which like elements to those in FIG. 5 are referred to with like reference numerals. The valve actuation system 2100 provides a fluid linkage 2130 between a master piston assembly 2120 and a slave piston assembly 2140. When isolated, the fluid linkage 2130 serves as a hydraulic link between the two piston assemblies so that motion of the master piston 2120 will transfer to the slave pistons 2141 and 2142. A trigger valve 2195 is provided to control the link between the master and slave pistons. A cams haft 20 is also provided. The cams haft includes various cam lobes capable of contacting the master piston.

Under normal operation, the trigger valve 2195 is open. The cams haft 20 turns in response to engine operation. The various cam lobes contact the master piston roller follower 2121 which in turn displaces the master piston. When the master piston assembly 2120 moves in response to a lobe of the cam 20, the oil volume displaced is absorbed by an unlimited accumulator 2190. No motion is transferred to the slave pistons 2141 and 2142. As a result, valve opening does not occur.

Upon receipt of an electric signal from the ECM 300, the trigger valve 2195 closes. The ECM 300 receives operator input and/or input from various engine parameters. When the trigger valve 2195 closes, a hard hydraulic link is formed between the master piston assembly 2120 and the slave piston 2141. The movement of the master piston is transferred to the slave piston and as a result the engine valves open.

The opening of the engine valves in FIG. 6 is sequential. The slave pistons 2141 and 2142 are normally biased in the raised position by the closed engine valve. The normal position of the first slave piston 2141 is shown by the dotted line in FIG. 6. Oil cannot flow to the second slave piston 2142 until the conduit 2145 is exposed. Thus, the engine valve corresponding to the first slave piston 2141 opens before the engine valve corresponding to the second slave piston 2142. As a result, swirl occurs in the gases admitted to the cylinder. The time delay in the sequence of valve openings is controlled by the position of the conduit 2145 and the length of the body of the first slave piston assembly 2141.

When the engine valves close, either by the action of the master piston 2120 receding or the trigger valve 2195 opening, the slave pistons 2141 and 2142 rise to their normal positions. At some point the first slave piston 2141 rises to a level which blocks the return oil flow from the second slave piston 2142 through the conduit 2145. Return oil from the second slave piston 2142 will continue to be returned to the system, when the conduit 2145 is closed, via a bypass line 2147. The bypass line 2147 may include a check valve 2146 to limit flow in the bypass line 2147 to one direction.

A positive power EGR lobe 22, shown in FIG. 6, may be activated or deactivated by closing or opening the trigger valve 2195 at the appropriate time (near dead bottom, intake stroke). When applied to the exhaust valve opening system, a braking mode and EGR braking augmentation may be activated by adding appropriate lobes on the cam 20, and closing the trigger valve 2195 at the appropriate times in the compression stroke and intake stroke respectively.

In an alternative embodiment, the system 2100 includes a limited accumulator 2190. A limited accumulator 2190 absorbs only a portion of the oil displaced by the master piston 2120. Consequently, when the trigger valve 2195 is open for small displacement cam lobes, such as, for example, EGR and braking lobes, displaced oil is absorbed in the accumulator 2190, and valve opening does not occur. However, for large displacement cam lobes, such as, for example, positive power intake and exhaust lobes, displaced oil is only partially absorbed. Subsequently, the hydraulic coupling becomes hard, the slave piston 2141 follows the displacement of the master piston 2120, and at least one valve is partially opened. This design provides a fail-safe positive power operating mode in the event of trigger valve 2195, or electronic control, failure. Otherwise, the system functions are controlled by the trigger valve 2195 in the same manner as the aforementioned base system.

Figure 7:
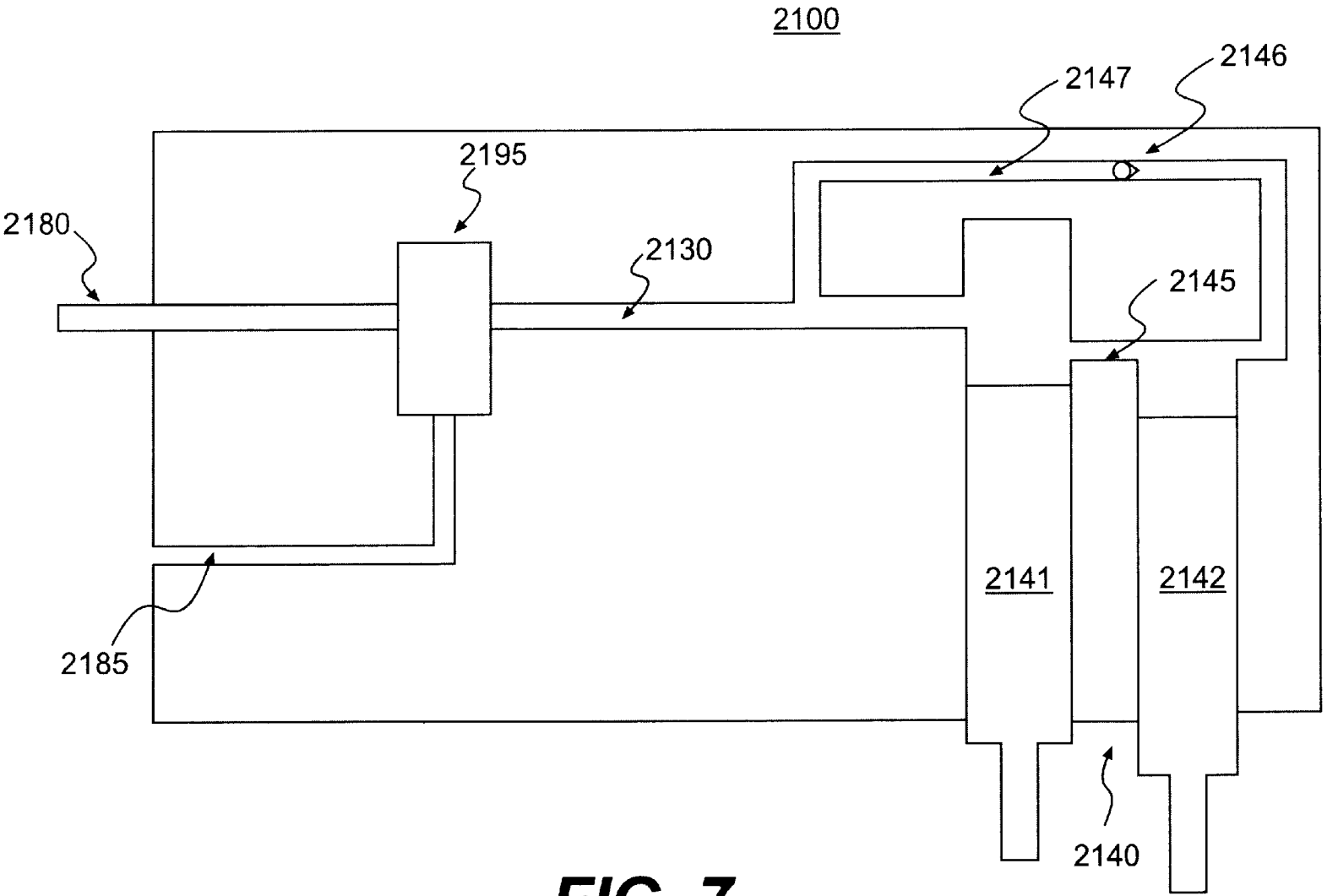
FIG. 7 is a schematic diagram of a valve actuation system according to a third embodiment of the present invention.

FIG. 7 is an example of a third embodiment of the present invention, in which like elements to those in FIGS. 5 and 6 are referred to with like reference numerals. A high pressure pump (not shown) would supply sufficient pressure to open the engine valves (typically 4000 psi). The trigger valve 2195 would normally be in the closed position, and the engine valves (not shown) would be closed.

To open the engine valves, an electrical signal is sent to the trigger valve 2195. Upon receiving the appropriate signal, the trigger valve 2195 opens. High pressure fluid (typically engine oil) passes from fluid linkage 2180 through the trigger valve 2195 and into fluid linkage 2130. The high pressure fluid may be blocked from proceeding through bypass line 2147 to the second slave piston 2142 by inline check valve 2146. As pressure increases in the system, the force of the oil overcomes the force of the engine valve springs (not shown) and cylinder pressure, and moves the first slave piston 2141 downward, opening the engine valve. As the first slave piston 2141 continues its downward movement, the conduit 2145 to the second slave piston 2142 becomes exposed. The oil continues to travel through the conduit 2145 filling the area above the second slave piston 2142, forcing it downward and opening the engine valve.

The engine valves shut when the trigger valve 2195 closes and allows the high pressure to bleed back through the low pressure return 2185. The valve springs return the slave pistons 2141 and 2142 to their normal raised positions. As the first slave piston 2141 closes off conduit 2145, any residual oil pressure above the second slave piston 2142 bleeds back through the bypass line 2147.

The common rail system described above further includes a clipping and valve seating device to address overstroke and valve seating issues such as described in U.S. Patent No.'s 5,000,145 and 5,577,46200 which are incorporated herein by reference.

It will be apparent to those skilled in the art that various modifications and variations can be made in the construction and configuration of the present invention without departing from the scope or spirit of the invention. For example, the fluid linkage in the system 2100 may be formed from tubing or an integral passage formed within housing 2110. The present invention may be used in connection with a cam profile having braking and positive power EGR lobes. It, however, is contemplated that the present invention may be used without engine braking and/or EGR. It is contemplated that the present invention may be used in an intake circuit and/or exhaust circuit. Furthermore, the valve 2150 may be actuated by hydraulic means, direct solenoid actuation or other suitable means for actuating the valve. The slave pistons 2141 and 2142 may include additional relief assemblies to prevent excess valve motion during braking. The followers on the master piston may comprise a suitable cam follower including, but not limited to, an oscillating follower, flat follower and/or roller follower. The above described system 2100 may be employed for the operation of both intake and exhaust valves.

The present invention provides a multi-valve system in which the timing of each engine valve for a given cylinder can be varied. The timing of the intake valves can be varied so that the intake valves for each cylinder open sequentially. The sequential opening of a cylinder's intake valves allows the air-fuel mixture to be further homogenized due to the enhanced eddy motion (swirl) created in the entering fuel-air mixture. The sequential opening of a cylinder's exhaust valves would provide for a single valve braking effect. The first valve would open against a fully charged cylinder and then the second would open for complete scavenging of the cylinder. The sequential opening of a set of engine valves offers the further advantage of requiring less force (high pressure oil) to open the valves, than is normally required to open multiple valves simultaneously.

The present invention is capable of varying the amount of separation between each valve and its corresponding valve seat (valve lift). Each valve within the multiple valve set may open or lift a different amount. The ability to vary the lift of the exhaust valves is an important improvement over conventional systems. During engine braking it is desirable to open the exhaust valve(s) as near Top Dead Center (TDC) of the compression stroke as possible. At this point in the cycle the piston's separation from the cylinder head is at its minimum. Opening of the exhaust valve(s) at this point must be controlled very closely. Opening the exhaust valves too rapidly or too much could result in catastrophic damage.

The present invention is also capable of controlling valve lift so that only certain engine valves within a set will open. The ability to maintain certain engine valves closed during the combustion or braking cycles, allows the system of the present invention to convert a multi-valve engine into a conventional one intake one exhaust valve system. Any number of engine valve combinations may be used, for example, multiple intake valves may be cycled with a single exhaust valve or vice versa.

When used in conjunction with an engine in the braking mode, the present invention offers numerous advantages. The amount of braking can be finely controlled by controlling the following parameters: number of exhaust valves which lift; the amount of valve lift; and the duration of valve lift. In an engine with at least a pair of exhaust valves for each cylinder, the magnitude of the braking force may controlled by varying the number of exhaust valves which open. For example, if only one exhaust valve per cylinder lifts during the braking cycle less braking will be provided than if both lift.

The present invention is also applicable to engine braking systems and Exhaust Gas Recirculating (EGR), and can be integrated within a full-authority valve control system The innovation of the present invention could also be applied to a common rail type of valve actuation system. Any system that utilizes a hydro-mechanical valve actuation could also utilize the system. Sequential opening of a cylinder's intake valves would improve swirl and the velocity of the incoming charge during the intake stroke, as well as enhance mixing during the positive power EGR function. On the exhaust side, sequential opening of exhaust valves would provide for a single valve braking effect. Opening a single valve against a fully charged cylinder and then the second to allow for complete scavenging of the cylinder.

While this invention has been described in conjunction with specific embodiments thereof, it is evident that many alternatives, modifications, and variations will be apparent to those skilled in the art. Accordingly, the preferred embodiments of the present invention, as set forth herein, were intended to be illustrative, not limiting. Various changes may be made without departing from the spirit and scope of the invention as defined in the following claims.

What is claimed is:

1. A method of optimizing engine braking power during an engine braking event for multiple engine speeds in a multi-valve internal combustion engine having a piston which reciprocates in a cylinder, said method comprising the steps of:

selecting an engine speed as a cross-over point between one-valve engine braking and multi-valve engine braking in the cylinder;

measuring at least one engine parameter to determine the current engine speed;

determining whether the current engine speed is above, equal to, or below the cross-over point engine speed; and modifying the operation of at least one engine valve in the cylinder during the engine braking event responsive to the determination of whether the current engine speed is above, equal to, or below the cross-over point engine speed.

2. The method of claim 1, wherein the step of modifying the operation of at least one engine valve further comprises the step of modifying the number of engine valves actuated responsive to the determination of whether the current engine speed is above, equal to, or below the cross-over point engine speed.

3. The method of claim 2, wherein the step of modifying the number of engine valves actuated comprises the step of actuating a plurality of engine valves if the current engine speed is above the cross-over point engine speed.

4. The method of claim 2, wherein the step of modifying the number of engine valves actuated comprises the step of actuating one engine valve if the current engine speed is equal to or below the cross-over point engine speed.

5. The method of claim 1, wherein the engine valve is an exhaust valve.

6. The method of claim 1, wherein the at least one engine parameter is selected from the group consisting of: intake manifold pressure, exhaust manifold pressure, and exhaust manifold temperature.

7. The method of claim 1, wherein the step of modifying the operation of at least one engine valve further comprises the step of modifying the timing of the operation of at least one engine valve if the current engine speed is above the cross-over point engine speed.

8. The method of claim 7, wherein the step of modifying the timing further comprises the step of advancing the opening of at least one engine valve during a cylinder compression stroke.

9. The method of claim 7, wherein the step of modifying the timing further comprises the step of delaying the closing of at least one engine valve during a cylinder compression stroke.

10. The method of claim 7, wherein the step of modifying the timing further comprises the steps of:

opening a first exhaust valve during a cylinder compression stroke; and opening a second exhaust valve during the cylinder compression stroke at a predetermined time after the opening of the first exhaust valve.

11. The method of claim 10, wherein the predetermined time is determined by braking load limits.

12. The method of claim 1, wherein the step of modifying the operation of at least one engine valve further comprises the step of modifying the lift of at least one engine valve.

13. A valve actuation system for actuating at least one engine valve to produce an engine braking event in a multi-valve internal combustion engine, the valve actuation system comprising:

a housing, having a fluid linkage formed therein;

means for selectively displacing hydraulic fluid located in the fluid linkage;

means for controlling the displacement of the hydraulic fluid in the fluid linkage to modify the operation of the at least one engine valve responsive to a determination of the current engine speed; and means for actuating the at least one engine valve to produce the engine valve event, said actuation means slidably received in said housing and operatively connected to said displacement means through the fluid linkage, wherein said displacement control means selectively modifies the operation of the at least one engine valve between one-valve operation and multi-valve operation during the engine braking event.

14. The valve actuation system of claim 13, wherein said displacement means further comprises:

a piston assembly slidably received in a bore formed in said housing, having means for contacting a cam and adapted to transmit motion through the hydraulic fluid located in the fluid linkage.

15. The valve actuation system of claim 13, wherein said displacement means further comprises:

a high-pressure fluid source adapted to store high-pressure fluid therein; and means for supplying the high-pressure fluid to the fluid linkage.

16. The valve actuation system of claim 13, wherein said displacement control means modifies the timing of the engine valves actuated.

17. The valve actuation system of claim 13, wherein the engine valve event is selected from the group consisting of: a normal intake valve event, a normal exhaust valve event, an engine braking event, and an EGR event.

18. A valve actuation system for selectively switching between one-valve actuation and multi-valve actuation to produce an engine valve event in a multi-valve internal combustion engine, the valve actuation system comprising:

a housing having first, second, and third internal bores and a fluid linkage formed therein;

a hydraulic fluid supply in communication with the fluid linkage;

a master piston assembly slidably disposed in the first bore;

a cam for imparting motion to said master piston assembly;

a first slave piston assembly slidably disposed in the second bore for actuating a first engine valve; and a second slave piston assembly slidably disposed in the third bore for actuating a second engine valve, said second slave piston assembly in selective communication with said master piston assembly.

19. The valve actuation system of claim 18, further comprising:

a hydraulic passage connecting said first slave piston assembly to said second slave piston assembly; and means for selectively supplying hydraulic fluid to said second slave piston assembly, said supply means disposed in said hydraulic passage.

20. The valve actuation system of claim 19, wherein said supply means comprises a pilot valve.

21. The valve actuation system of claim 19, wherein said supply means selectively switches between a first position blocking the supply of hydraulic fluid to said second slave piston assembly, and a second position permitting the supply of hydraulic fluid to said second slave piston assembly.

22. The valve actuation system of claim 18, further comprising means for limiting the stroke of said first slave piston assembly.

23. A The valve actuation system of claim 22, said stroke limiting means comprising:

a relief passage in fluid communication with the second bore; and an accumulator assembly in communication with said relief passage.

24. The valve actuation system of claim 18, further comprising valve means for providing selective communication between said hydraulic fluid supply and the fluid linkage.

25. The valve actuation system of claim 18, further comprising a hydraulic passage connecting said first slave piston assembly to said second slave piston assembly.

26. The valve actuation system of claim 25, said first slave piston assembly having a normally biased position and said first slave piston assembly blocking said hydraulic passage when in the normally biased position.

27. The valve actuation system of claim 26, further comprising a hydraulic bypass passage connecting the third bore with the fluid linkage.

28. The valve actuation system of claim 27, further comprising a check valve disposed in said bypass passage.

29. A valve actuation system for selectively switching between one-valve actuation and multi-valve actuation to produce an engine valve event in a multi-valve internal combustion engine, the valve actuation system comprising:

a housing having first, second, and third internal bores and a fluid linkage formed therein;

a hydraulic fluid supply in communication with the fluid linkage;

a master piston assembly slidably disposed in the first bore;

a cam for imparting motion to said master piston assembly;

a first slave piston assembly slidably disposed in the second bore for actuating a first engine valve;

a second slave piston assembly slidably disposed in the third bore for actuating a second engine valve;

a hydraulic passage connecting said first slave piston assembly to said second slave piston assembly; and valve means disposed in said hydraulic passage for selectively supplying hydraulic fluid to said second slave piston assembly and permitting actuation of the first and second engine valves.

* * * * *